US008136451B2

(12) United States Patent
Mutascio

(10) Patent No.: US 8,136,451 B2
(45) **Date of Patent: *Mar. 20, 2012**

(54) AMMUNITION ASSEMBLY WITH ALTERNATE LOAD PATH

(75) Inventor: Enrico R. Mutascio, Palm Springs, CA (US)

(73) Assignee: Armtec Defense Products Co., Coachella, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/075,018

(22) Filed: Mar. 29, 2011

(65) Prior Publication Data

US 2011/0192310 A1 Aug. 11, 2011

Related U.S. Application Data

(63) Continuation of application No. 11/683,230, filed on Mar. 7, 2007, now Pat. No. 7,913,625.

(60) Provisional application No. 60/790,492, filed on Apr. 7, 2006.

(51) Int. Cl.
*F42B 5/18* (2006.01)

(52) U.S. Cl. ..... 102/431; 102/700; 102/206; 102/215

(58) Field of Classification Search ..... 102/431–433, 102/700, 206, 215, 472; 89/6
See application file for complete search history.

(56) References Cited

U.S. PATENT DOCUMENTS

| | | | |
|---|---|---|---|
| 260,153 | A | 6/1882 | Bennett |
| 2,072,671 | A | 3/1937 | Foulke |
| 2,322,624 | A | 6/1943 | Forbes |
| 2,346,792 | A | 4/1944 | Rush |
| 2,383,053 | A | 8/1945 | Fenger et al. |
| 2,489,337 | A | 11/1949 | Sperling |
| 2,775,943 | A | 1/1957 | Ekserzian |
| 2,824,755 | A | 2/1958 | Lamphear |
| 2,862,446 | A | 12/1958 | Ringdal |
| 2,866,412 | A | 12/1958 | Meyer et al. |
| 2,996,988 | A | 8/1961 | Kunz |
| 3,077,330 | A | 2/1963 | Lamphear |
| 3,127,148 | A | 3/1964 | Collar |
| 3,160,099 | A | 12/1964 | Nooker |
| 3,194,161 | A | 7/1965 | Becker et al. |

(Continued)

FOREIGN PATENT DOCUMENTS

DE 2705235 8/1978

(Continued)

OTHER PUBLICATIONS

International Search Report dated Mar. 28, 2003 for PCT Application PCT/US/02/33906.

International Search Report for International Application No. PCT/US02/38033, Armtec Defense Products Co., Dec. 4, 2003 (2 pages).

Tim Thompson, Dipak Kamdar, "Computer Modeling of Pressures on 120mm Tank Round in the M256 Gun" presented at the National Defense Industrial Association 36th Annual Gun & Ammunition Symposium & Exhibition, Apr. 10, 2001, Alliant Techsystems.

*Primary Examiner* — Michael David
(74) *Attorney, Agent, or Firm* — Perkins Coie LLP

(57) ABSTRACT

An ammunition round assembly with alternate load path is disclosed herein. The ammunition round assembly includes a projectile, a body engaging the projectile, and a non-combustible base at least partially enclosing the body. A structural member having first and second engagement portions opposite to each other is positioned inside an interior space defined by the body and the base. The first engagement portion firmly engages the base, and the second engagement portion firmly engages the projectile to provide an alternate load path between the projectile and the base.

34 Claims, 9 Drawing Sheets

U.S. PATENT DOCUMENTS 3,224,371 A * 12/1965 Kempton et al. ..... 102/474
3,224,372 A 12/1965 Nooker
3,249,050 A 5/1966 Cordle et al.
3,320,888 A 5/1967 Churchill
3,434,422 A 3/1969 Herman et al.
3,485,170 A 12/1969 Scanlon
3,490,374 A 1/1970 Nooker
3,561,725 A 2/1971 Torres
3,605,624 A 9/1971 Dinsdale et al.
3,609,115 A 9/1971 Sammons et al.
3,658,008 A 4/1972 Larson
3,662,802 A 5/1972 Bedell
3,680,483 A 8/1972 Staudacher et al.
3,690,257 A 9/1972 Nooker et al.
3,696,750 A 10/1972 Colgate et al.
3,696,751 A 10/1972 Kempton
3,705,549 A 12/1972 Quinlan et al.
3,713,390 A 1/1973 Pieper
3,720,168 A 3/1973 Sylwester
3,742,856 A 7/1973 Welanetz
3,745,927 A 7/1973 Tanner et al.
3,791,303 A 2/1974 Sweeney et al.
3,808,973 A 5/1974 Galluzzi
3,814,017 A 6/1974 Backstein et al.
3,853,645 A 12/1974 Kaufman et al.
3,863,254 A 1/1975 Turner
3,878,396 A 4/1975 Vallet
3,885,727 A 5/1975 Gilley
3,894,679 A 7/1975 Reifers et al.
3,895,578 A 7/1975 Shaw et al.
3,901,153 A 8/1975 Brabets et al.
3,910,189 A 10/1975 Whidden et al.
3,911,824 A 10/1975 Barr et al.
3,938,441 A 2/1976 Sewell et al.
3,955,506 A 5/1976 Luther et al.
3,986,655 A 10/1976 Rynning
4,015,527 A 4/1977 Evans
4,036,103 A 7/1977 Gawlick et al.
4,069,762 A 1/1978 Maury
4,077,326 A 3/1978 Funk et al.
4,098,625 A 7/1978 French et al.
4,196,129 A 4/1980 Rhein et al.
4,197,801 A 4/1980 LaFever et al.
4,220,089 A 9/1980 Smith
4,237,789 A 12/1980 Stauers et al.
4,276,100 A 6/1981 Colvin et al.
4,289,295 A 9/1981 Allread
4,335,657 A 6/1982 Bains
4,392,432 A 7/1983 Fenrick et al.
4,404,912 A 9/1983 Sindermann
4,434,718 A 3/1984 Kopsch et al.
4,435,481 A 3/1984 Baldi
4,444,115 A 4/1984 Romer et al.
4,446,793 A 5/1984 Gibbs
4,459,915 A 7/1984 Lynch
4,505,203 A 3/1985 Brady et al.
4,535,697 A 8/1985 Moser et al.
4,593,622 A 6/1986 Fibranz
4,604,954 A 8/1986 Clarke et al.
4,640,195 A 2/1987 Campoli
4,739,708 A 4/1988 Halpin et al.
4,763,577 A 8/1988 Romer et al.
4,768,439 A 9/1988 Singer et al.
4,802,415 A 2/1989 Clarke et al.
4,815,390 A 3/1989 Garcia
4,863,534 A 9/1989 Forsberg
4,867,036 A 9/1989 Haskins
4,881,464 A 11/1989 Sayles
4,907,510 A 3/1990 Martwick et al.
4,941,244 A 7/1990 Ortmann et al.
5,029,530 A 7/1991 Martwick et al.
5,042,388 A 8/1991 Warren et al.
5,078,051 A 1/1992 Amundson
5,090,323 A 2/1992 Kallevig et al.
5,097,765 A 3/1992 Ziemba
5,121,692 A 6/1992 DiCarlo
5,136,950 A 8/1992 Halpin et al.
5,138,949 A 8/1992 Swartout et al.
5,147,973 A 9/1992 Ziemba
5,155,295 A 10/1992 Campoli
5,160,804 A 11/1992 Wahner et al.
5,233,928 A 8/1993 Ducros et al.
5,265,540 A 11/1993 Ducros et al.
5,289,776 A 3/1994 Thiesen et al.
5,317,163 A 5/1994 Obkircher
5,333,551 A 8/1994 Heitmann et al.
5,335,599 A 8/1994 Thiesen et al.
5,343,794 A 9/1994 Andreotti et al.
H001367 H 11/1994 Allen, Jr. et al.
5,361,700 A 11/1994 Carbone
5,388,522 A 2/1995 Martwick et al.
5,400,714 A 3/1995 Thiesen et al.
5,400,715 A 3/1995 Roach et al.
5,415,104 A 5/1995 Bispling et al.
5,423,262 A 6/1995 Pettersson et al.
5,433,148 A 7/1995 Barratault et al.
5,456,455 A 10/1995 Dillehay et al.
5,467,716 A 11/1995 Boual
5,524,546 A 6/1996 Rozner et al.
5,526,751 A 6/1996 Spivey et al.
5,531,163 A 7/1996 Dillehay et al.
5,557,059 A 9/1996 Warren et al.
5,561,260 A 10/1996 Towning et al.
5,563,365 A 10/1996 Dineen et al.
H001603 H 11/1996 Deckard et al.
5,610,365 A 3/1997 Thiesen
5,631,441 A 5/1997 Briere et al.
5,639,984 A 6/1997 Nielson
5,650,589 A 7/1997 Thiesen
5,661,257 A 8/1997 Nielson et al.
5,679,921 A 10/1997 Hahn et al.
5,827,958 A 10/1998 Sigler
5,841,062 A 11/1998 Manole et al.
5,907,121 A 5/1999 Fritze
5,912,430 A 6/1999 Nielson
6,013,144 A 1/2000 Callaway
6,119,600 A 9/2000 Burri
6,158,348 A 12/2000 Campoli
6,276,277 B1 8/2001 Schmacker
6,284,990 B1 9/2001 Arnold et al.
6,311,622 B1 11/2001 Adimari
6,389,976 B1 5/2002 Zacharin
H002039 H 8/2002 Holt et al.
6,427,599 B1 8/2002 Posson et al.
6,450,099 B1 9/2002 Desgland
6,457,603 B1 10/2002 Freist et al.
6,460,460 B1 10/2002 Jasper, Jr. et al.
6,526,892 B2 3/2003 Heitmann et al.
6,725,781 B2 4/2004 Niemeyer et al.
6,745,697 B2 6/2004 Haak et al.
6,748,870 B2 6/2004 Heidenreich et al.
6,901,866 B2 6/2005 Mutascio et al.
7,726,245 B2 6/2010 Quesenberry et al.
2002/0088367 A1 7/2002 Mac Aleese et al.
2003/0121444 A1 7/2003 Mutascio et al.
2006/0081149 A1 4/2006 Salizzoni et al.
2007/0289474 A1* 12/2007 Mutascio ..... 102/431
2009/0145320 A1 6/2009 Harrison
2009/0217836 A1 9/2009 Dietrich et al.
2010/0229750 A1 9/2010 Mutascio

FOREIGN PATENT DOCUMENTS

EP 463904 A1 1/1992
EP 0483787 5/1992
EP 0307307 B1 7/1992
FR 2385075 10/1978
FR 2702554 A1 9/1994
GB 732633 6/1955
GB 2044416 10/1980
GB 2266944 A 11/1993
WO WO-94/20813 A1 9/1994
WO WO-94/20814 A1 9/1994
WO WO-99/24778 5/1999

* cited by examiner

AMMUNITION ASSEMBLY WITH ALTERNATE LOAD PATH

CROSS-REFERENCE TO RELATED APPLICATIONS

The present application is a continuation of U.S. patent application Ser. No. 11/683,230, filed on Mar. 7, 2007 now U.S. Pat. No. 7,913,625 and titled AMMUNITION ASSEMBLY WITH ALTERNATIVE LOAD PATH, which claims priority to and the benefit of U.S. Provisional Patent Application No. 60/790,492, filed on Apr. 7, 2006 and titled AMMUNITION ASSEMBLY WITH ALTERNATE LOAD PATH, each of which is incorporated herein in its entirety by reference thereto.

TECHNICAL FIELD

This document describes a configuration for ammunition, including large-bore ammunition having combustible cartridge cases and an alternate load path.

BACKGROUND

Combustible Cartridge Cased (CCC) ammunition has been widely used since the 1970's. A typical CCC ammunition round can include three main components. The first is a projectile to be released upon firing. The second is a generally cylindrical CCC body that has a first end engaging the projectile, a second end opposite the first end, and an interior area for containing a propellant. The third is a composite case base interfacing with the second end of the CCC body. The CCC body can be constructed from suitable combustible materials including, for example, nitrocellulose.

In the CCC ammunition round, excessive loads from the projectile can damage the CCC body or other components of the ammunition round. Typically, the projectile is the heaviest component of the ammunition round. As a result, the projectile can impose heavy loads upon the CCC body during transporting, loading, or other handling processes. However, the combustible materials used in the CCC body normally do not have sufficient structural strength to bear such heavy loads. Consequently, excess loads on the CCC body can compromise the structural integrity of the ammunition round.

One promising solution to reduce the risk of damage from loads imposed upon a CCC body of a type of CCC ammunition assembly is described in U.S. Pat. No. 6,901,866, which is incorporated herein in its entirety by reference. The '866 patent discloses a load-bearing unit that defines a load path substantially independent of the CCC body. Additional systems or features for enhancing the load bearing capability of CCC ammunition assemblies would be desirable.

DETAILED DESCRIPTION

A Combustible Cartridge Cased (CCC) ammunition assembly and corresponding methods for assembling the ammunition assembly in accordance with one or more embodiments of the present invention are described in detail herein. The following description sets forth numerous specific details, such as specific materials usable for the assembly and specific structures for use in manufacturing the assembly, to provide a thorough and enabling description for embodiments of the invention. One skilled in the relevant art, however, will recognize that the invention can be practiced without one or more of the specific details. In other instances, well-known structures or operations are not shown, or are not described in detail to avoid obscuring aspects of the invention.

Figure 1:
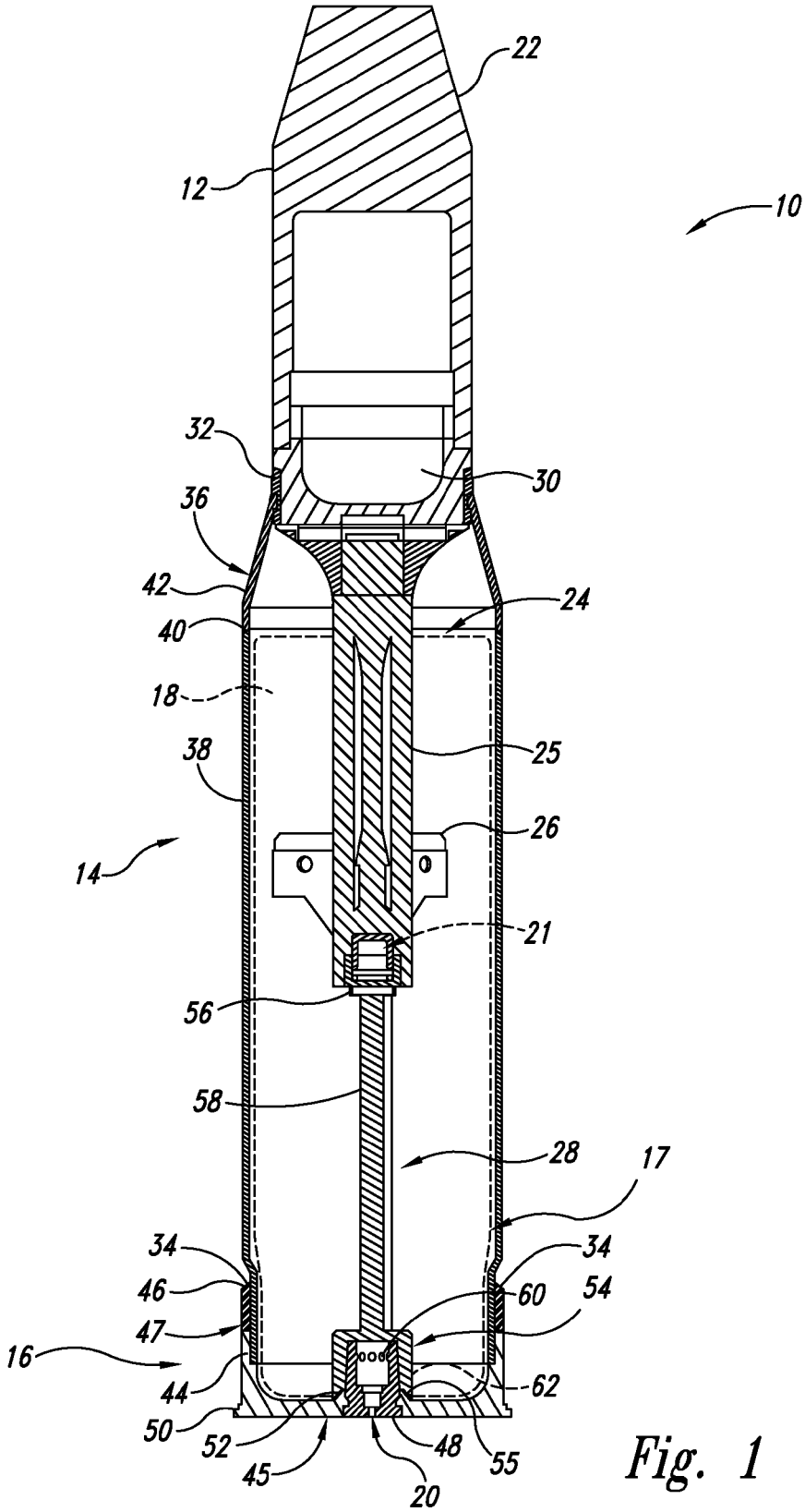
FIG. 1 is a cross-sectional view of a Combustible Cartridge Cased (CCC) ammunition assembly in accordance with an embodiment of the present invention.

FIG. 1 is a cross-sectional view of a CCC ammunition assembly 10 in accordance with an embodiment of the present invention. In the illustrated embodiment, the ammunition assembly 10 includes a projectile 12, a combustible body 14 at least partially enclosing the projectile, and a case base 16 forming a closed-ended bottom of the ammunition assembly 10. The body 14 and the case base 16 define an interior area 17 that contains a propellant charge 18 (partially shown in phantom lines for purposes of clarity). The ammunition assembly 10 further includes a structural member 28 that interconnects the projectile 12 and the case base 16. The structural member 28 forms an alternate load path to transmit at least one of a compression, tension, torsion, and bending force between the projectile 12 and the case base 16. The ammunition assembly 10 further includes an ignition device 20 (e.g., a primer) that can ignite the propellant charge 18 upon firing. Optionally, the ammunition assembly 10 can further include a tracer 21 positioned between the structural member 28 and the projectile 12.

In the illustrated embodiment, the projectile 12 includes a proximal portion 22 extending from the body 14 and a distal portion 24 enclosed in the body 14. The proximal portion 22 of the projectile can include a warhead containing, for example, an explosive charge. Optionally, the projectile 12 can be a programmable member and may include a programmable fuse (e.g., a "smart fuse" 30) to enable programming of the projectile 12 before, during, or after the projectile is loaded into a firing device (not shown). The distal portion 24 of the projectile can include devices configured for structural support, flight stabilization, measurement collection, or other purposes. In the illustrated embodiment, the distal portion 24 includes an elongated member 25 having a plurality of fins 26 attached thereto. The distal portion 24 extends into the interior area 17 of the body 14 and is adjacent to or surrounded by the propellant charge 18. In other embodiments, the distal portion 24 can be shorter, such that the distal portion does not extend as far into the interior area of the body 14.

In the illustrated embodiment, the combustible body 14 is a two-piece body with a proximal component 36 and a distal component 38 interconnected at a joint area generally adjacent to the projectile. In one embodiment, the joint area is formed by a skive joint 40 and an adhesive, fasteners, or other securing means. The proximal component 36 has a tapered case shoulder 42 and an open end 32 shaped and sized to removably receive at least a portion of the projectile 12. The open end 32 can have various conventional features for engaging the projectile 12, including, for example, hangers, threads, holes, grooves, notches, etc. The other end of the body's proximal component has a diameter that generally corresponds with the diameter of the distal component to provide a smooth transition area on the body.

The distal component 38 of the combustible body has a substantially cylindrical shape and an open end 34 shaped and sized to engage the case base 16. The body 14 is fabricated from a combustible composite material, such as a resinated molded fiber composite with an energetic component in the form of nitrocellulose fibers. In other embodiments, other types of combustible composite materials can be used.

The case base 16 includes a metallic cup portion 44 having a closed end 45, an open end 47, and an elastomeric ring 46 attached to the open end 47. The closed end 45 provides a solid mounting feature (e.g., a primer boss 48) for attaching the ignition device 20 or other devices that can ignite the propellant charge 18. The outside edge of the closed end 45 defines a rim 50 configured for properly locating the ammunition assembly 10 in a firing device. The open end 47 of the case base 16 has an internal diameter slightly greater than an outer diameter of the body 14 at the end 34. The case base 16 and the end 34 of the body 14 at least partially overlap to form a lap-type joint secured together with, for example, an adhesive, a fastener, or other securing mechanism.

When the case base 16 is attached to the second end 34 of the body 14, the primer boss 48 is generally coaxially aligned with the body and extends toward the interior area 17. In the illustrated embodiment, the primer boss 48 is attached to the structural member 28 extending through the interior area 17 within the body 14. The structural member 28 includes a first engagement portion 54 that connects to the primer boss 48, a second engagement portion 56 that connects to the projectile, and an intermediate portion 58 extending between the first and second engagement portions. The first engagement portion 54 of the illustrated embodiment is a cup-shaped portion that includes a beveled end that mates with a beveled surface of the primer boss 48. The first engagement portion 54 further includes or is connected to an anti-rotation device 62 that engages the case base and is configured to prevent the structural member from rotating relative to the case base 16. In the illustrated embodiment, the intermediate portion 58 is integrally connected to the first and second engagement portions and has sufficient rigidity to transmit loads from the projectile 12 to the case base 16 while substantially bypassing the case body. Embodiments of the structural member 28 are described in more detail below with reference to FIGS. 3A-D and 7A and 7B.

The primer boss 48 and the cup-shaped first engagement portion 54 of the structural member 28 are configured to contain and protect the ignition device 20. The ignition device 20 of the illustrated embodiment contains various electrical contacts (e.g., ignition bridge wires) and an ignition compound (e.g., Benite sticks or granular black powder). The ignition device 20 extends through the primer boss 48 of the case base 16 and into the cup-shaped first engagement portion 54 of the structural member 28. In the illustrated embodiment, the ignition device 20 is substantially contained between the primer boss 48 and the first engagement portion 54. The first engagement portion 54 has a plurality of apertures therein that communicate with the propellant charge 18, so that heat, hot gases, and/or flame from the ignition device upon activation will pass through the apertures and ignite the propellant charge. In other embodiments, the ignition device 20 can extend beyond the first engagement portion 54, as described in more detail below with reference to FIG. 5.

During assembly of one embodiment, the projectile 12 is attached to the proximal component 36 of the body 14 adjacent to the first open end 32, and the structural member 28 is securely connected to the projectile 12. The case base 16 is attached to the distal component 38 of the body 14 adjacent to the second open end 34. The projectile/proximal component/structural member assembly is attached to the distal component/case base assembly to form the skive joint 40 as discussed above. The propellant charge 18 is also disposed in the distal component/case base assembly and around the structural member 28 and a base portion of the projectile. Then, the ignition device 20 is inserted through the case base 16 via the primer boss 48 to engage the structural member 28, thereby securely fastens the structural member 28 and the case base 16 together.

During loading, transporting, or other handling processes, the structural member 28 provides the load path for loads applied to the case base and/or the projectile 12, thereby substantially isolating the loads from the body 14. For example, in one embodiment, if the projectile 12 is rotated relative to the body 14, a torsion force is transmitted from the projectile to the case base 16 via the structural member 28. As a result, the case base 16 forces the body 14 to rotate in the same direction as the projectile 12. In another embodiment, if the projectile 12 is compressed against the body 14, the structural member 28 transmits a compression force directly to the case base 16. The case base 16 has sufficient strength to bear such loads because the case base 16 is at least partially constructed from metallic or metal alloy materials. As a result, damage to the body 14 can be avoided because the projectile 12 imposes the compression force upon the case base 16 instead of the body 14. Consequently, damage to the combustible body can be avoided, thereby preserving the integrity of the ammunition assembly 10.

Figure 2A:
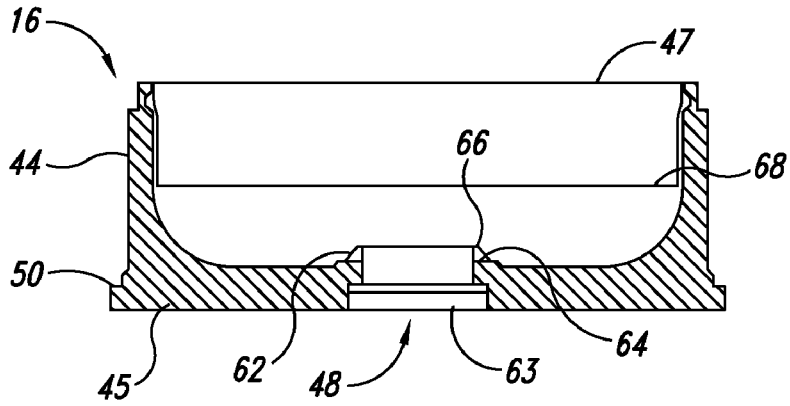
FIG. 2A is a partial cross-sectional view.
Figure 2B:
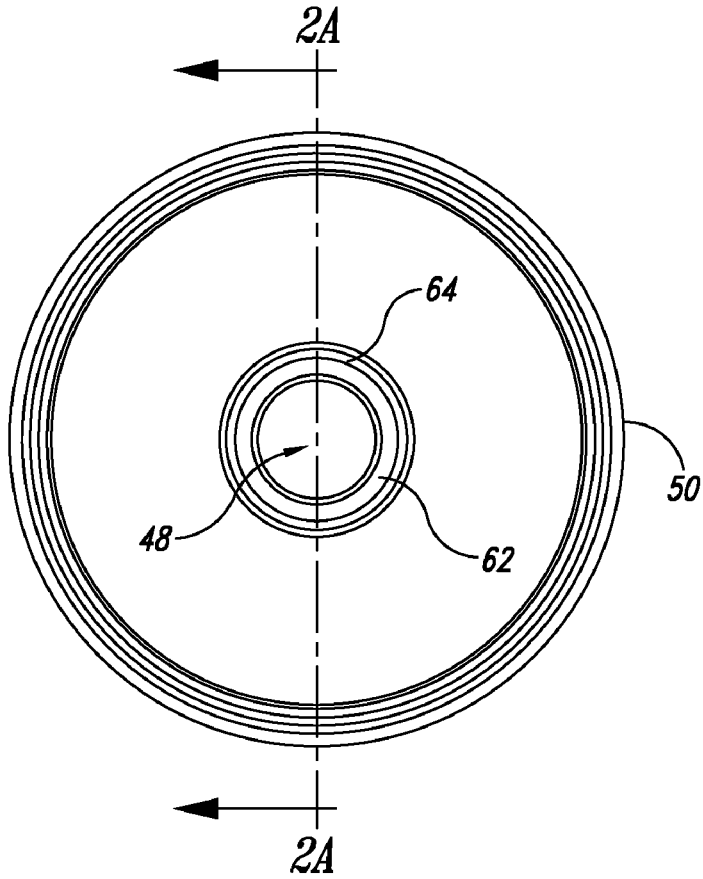
FIG. 2B is a top view of the case base shown removed from the assembly of FIG. 1.

FIG. 2A is a partial cross-sectional view and FIG. 2B is a top view of the case base 16 shown removed from the assembly of FIG. 1 in accordance with one embodiment of the invention. In the illustrated embodiment, the elastomer ring 46 has been removed for clarity. In one aspect of this embodiment, the primer boss 48 is located in a generally central region of the closed end 45 of the case base 16. The primer boss 48 extends into the interior space of the case base 16 and includes a passage 63 configured to allow the ignition device 20 to extend therethrough. The case base 16 also includes a lip 68 sized to accept the second open end 34 of the body 14. The lip 68 provides a surface against which the body will press when inserted into the case base, thereby acting as a stop for properly positioning the body 14 into the case base 16 during assembly.

Figure 3A:
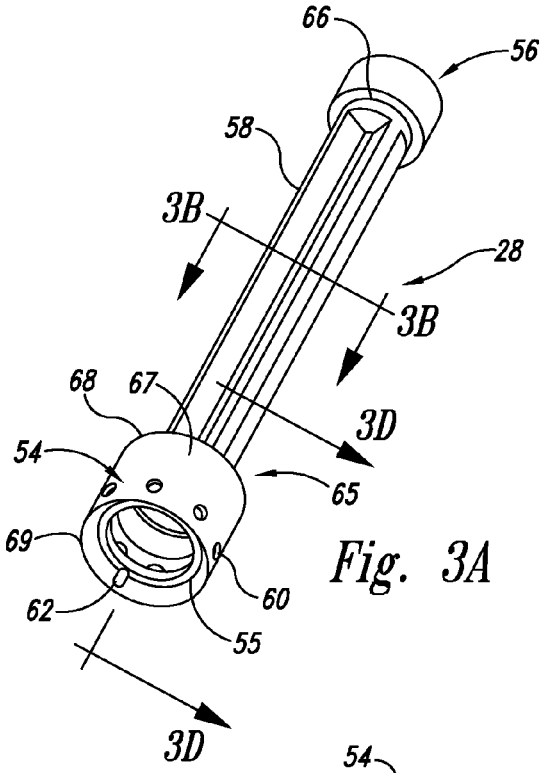
FIGS. 3A-D are various views of the structural member shown removed from the assembly of FIG. 1.

FIG. 3A is an isometric view of the structural member 28 shown removed from the assembly of FIG. 1 in accordance with an embodiment of the present invention. In the illustrated embodiment, the first engagement portion 54 of the structural member includes a first cup-shaped structure 65 having a side wall 67 extending between a closed end 68 and an open end 69. The closed end 68 and the side wall 67 include a plurality of apertures 60 therethrough defining passages between the internal space of the first cup-shaped structure 65 and the propellant charge 18 (FIG. 1) surrounding the first engagement portion 54. The closed end 68 is rigidly attached to the intermediate portion 58. In the illustrated embodiment, the intermediate portion 58 is integrally connected to first engagement portion 54. Other rigid joining techniques, such as welding, mechanically fastening, or bonding, can be used in other embodiments. The first engagement portion 54 can be constructed from any suitable material including, for example, metals, metal alloys, composites, and/or any other suitable material with sufficient strength, durability, and heat resistance.

The first cup-shaped structure 65 includes an inner surface 59 and an outer surface 61 (FIG. 3C) and a countersunk tapered surface 55 extending between the two surfaces 59 and 61 thereby defining the open end 55 of the first engagement portion 54. The inner surface 59 includes internal threads 71. The countersunk tapered surface 55 is shaped and sized to mate with a tapered surface 52 on the primer boss 48 on the case base 16 (FIG. 2A). The first engagement portion 54 also includes an anti-rotation device 62 extending from the countersunk tapered surface 55. In the illustrated embodiment, the anti-rotation device 62 is a pin pressed, welded, threaded, or otherwise securely connect to the first cup-shaped structure 65. The anti-rotation device 62 of the illustrated embodiment is shaped and sized to extend into a groove 64 or other receptacle found in the primer boss 48 (FIG. 2) of the case base 16 and configured to engage the anti-rotation device to substantially prevent the structural member 28 and the projectile from rotating relative to the case base 16. In other embodiments, the anti-rotation device 62 can be projecting from the primer boss 48 and configured to extend into a groove or other receptacle area on the first engagement portion 54 to create an interface that substantially prevents rotational motion between the structural member 28 and the case base 16 when the ammunition assembly 10 is assembled. In other embodiments, other anti-rotation arrangements can be used so as to prevent such rotational motion when the ammunition assembly 10 is assembled.

The primer boss 48 and the first engagement portion 54 of the structural member 28 are configured so the engagement therebetween acts as an alignment means to help maintain proper alignment of the structural member relative to the case base 16 and the body during and after assembly. For example, the tapered surfaces 52 and 55 of the primer boss 48 and the first engagement portion, respectively, can be configured to engage and ensure that the structural member 28 and the projectile 12 are substantially perpendicular to the bottom of the case base 16. In other embodiments, the tapered surfaces 52 and 55 can be configured to achieve other desired alignments or spatial relationship between the projectile 12 and the case base 16.

Figure 3B:
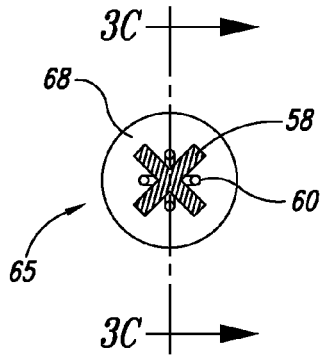

In the illustrated embodiment, the intermediate structural portion 58 of the structural member 28 is a solid structure having a cross-shaped cross section (FIG. 3B). In other embodiments, the intermediate portion 58 can have other shapes and configuration including, for example, a tubular shape, a rectangular shape, etc. The intermediate portion 58 is constructed of a material, such as metal, metal alloy, composite, plastic, and/or any other suitable material with sufficient strength, axial and torsional rigidity, and durability to react the axial and torsional loads applied to the ammunition assembly 10, thereby protecting the combustible body 14 from damage.

The second engagement portion 56 of the structural member 28 is opposite the first engagement portion 54 and is rigidly attached to the intermediate portion 58. The second engagement portion 56 is securely fixed to an end of the projectile 12. In one embodiment, the second engagement portion is threadably attached to the projectile, and the threaded interface is bonded together so the projectile cannot rotate relative to the structural member after assembly is complete. In other embodiments, other securing techniques can be used to securely and rigidly interconnect the projectile and the structural member.

Figure 3C:
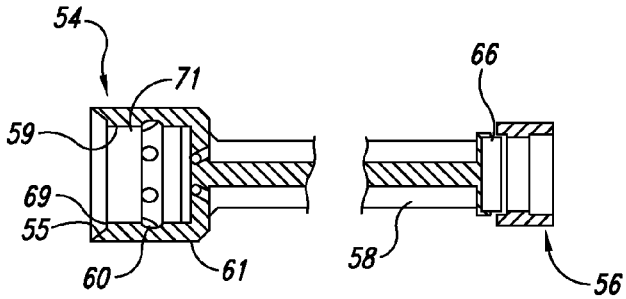
Figure 3D:
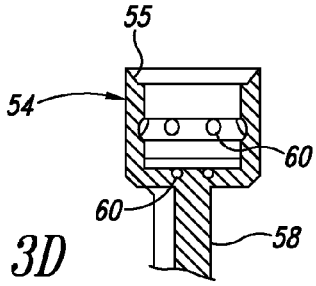

The second engagement portion 56 of the illustrated embodiment includes a break-joint feature 66 that allows the projectile 12 to separate from the structural member 28 when the ammunition assembly 10 is fired. As seen in FIG. 3C, the break-joint feature 66 of the illustrated embodiment includes a hollow tubular section having a reduced wall thickness. In other embodiments, the break-joint feature 66 can have other configurations, such as a solid section with a plurality of apertures therein, or a section constructed from a different material, so as to provide an intentional area of weakness for separation from the projectile only under loads created when the ammunition assembly is fired. The break-joint feature 66 is configured to transmit loads, such as compression, tensile, torsion, and bending loads, from the projectile 12 to the structural member 28 and the case base 16 while substantially bypassing the combustible body. The break-joint feature 68 is configured to break under tensile loads and separate from the projectile only upon firing of the ammunition assembly 10.

During firing the ammunition assembly 10 in a firing device, the break-joint feature 66 prevents the projectile 12 from moving in the firing device before a desired chamber pressure (commonly referred to as a "short-start" pressure) has been reached. Upon firing, the ignition device 20 ignites the propellant charge 18. The burning propellant 18 generates gases that increase the chamber pressure in the firing device. As a result, a significant tensile load is applied to the break-joint feature 66 because the structural member 28 remains fixed to the case base 16. As the chamber pressure approaches the short-start pressure, the break-joint feature 66 remains intact and holds the projectile 12 to the structural member 28 and the case base 16 together. Once the chamber pressure reaches the short-start pressure, the break-joint feature 66 disjoints to allow the projectile 12 to separate from the case base 16 and travel through the firing device. As such, the break-joint feature 66 delays the movement of the projectile 12 in the firing device until the short-start pressure is reached. Such delay can improve the trajectory of the projectile 12 because the initial velocity of the projectile 12 leaving the firing device can be increased.

Figure 4:
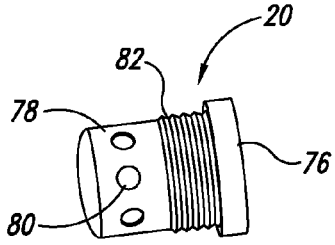
FIG. 4 is an isometric view of the ignition device shown removed from the assembly of FIG. 1.

FIG. 4 is an isometric view of the ignition device 20 shown removed from the ammunition assembly 10 of FIG. 1 in accordance with one embodiment of the invention. The illustrated ignition device 20 is a primer that includes a body portion 78 and a head portion 76. The body portion 76 is sized to extend through a central aperture in the case base 16 and at least partially into the cup-shaped structure 65 of the structural member 28 within the interior area of the case base and/or the body so as to be generally adjacent to the propellant charge 18. The body portion 76 of the illustrated embodiment has a plurality of external threads 82 configured to threadably engage the internal threads 71 on the inner surface 59 of the structural member's first cup-shaped structure 65. The external threads in one embodiment can also screw into the primer boss 48 of the case base 16. In the illustrated embodiment, the primer boss 48 does not have internal threads. The body portion 78 has a diameter smaller than the diameter of the head portion 76, and the head portion is sized to fit in a recess portion of the case base so that the head portion will not fully pass through the central aperture in the case base 16 (FIG. 1). Accordingly, the ignition device 20 screws into the primer boss and the end of the structural member, thereby locking the case base and the structural member together.

In one embodiment, the body portion 78 contains an ignition compound that will be ignited to initiate the firing of the ammunition assembly 10. The body portion 78 also includes a plurality of apertures 80 therethrough in communication with the ignition compound. The apertures 80 are configured to allow burning gases and/or flame from the ignition compound to pass therethrough and through the apertures 60 in the structural member's first engagement portion 54 so as to ignite the propellant charge 18. In one embodiment, the head and body tube portions are constructed from non-combustible materials, such as metal or any other suitable non-combustible material. In other embodiments, the ignition device can be constructed from a body combustible material so that the ignition device is fully consumed when the ammunition assembly is fired.

Figure 5:
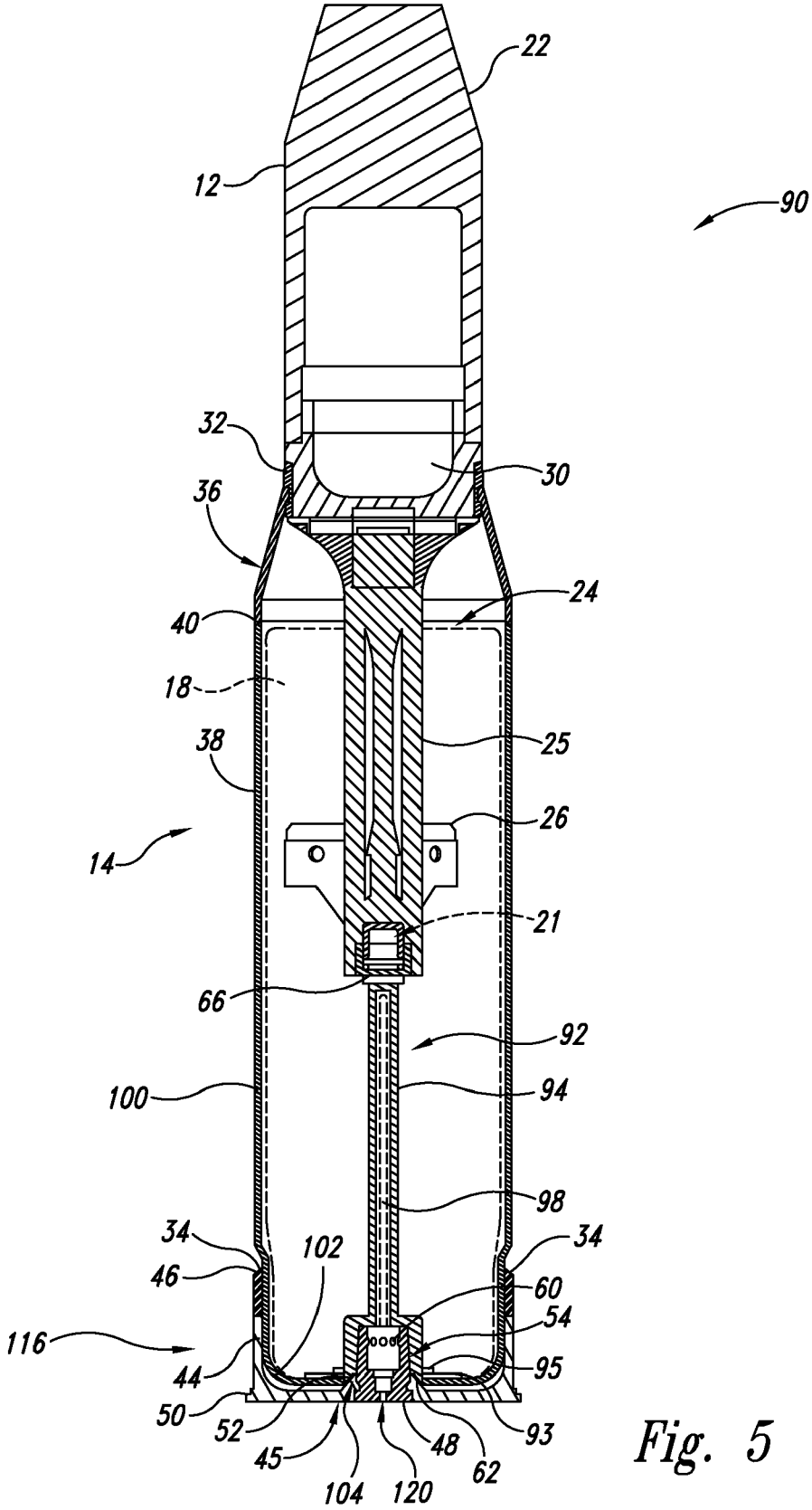
FIG. 5 is a cross-sectional view of a CCC ammunition assembly in accordance with another embodiment of the present invention.

FIG. 5 is a cross-sectional view of an ammunition assembly 90 in accordance with another embodiment of the present invention. In this embodiment, several components of the ammunition assembly 90 are similar to the components of the ammunition assembly 10 described above. As such, like reference symbols refer to like features and components in FIGS. 1-4. In one aspect of this embodiment, the distal component 38 of the body 14 includes a generally cylindrical section 100 and a domed lower section 102 with a central hole 104. The domed section 102 is sized to fit within the case base 16 so that the central hole 104 is axially aligned with the aperture in the case base. The primer boss 48 extends through the central hole 104 and into the interior area of the body. The dome section 102 is securely retained in the case base 116 by using a retention device, for example, a spring disc 93 and a snap ring 95 that securely engage the primer boss, as described in more detail below with reference to FIGS. 9-11.

In one embodiment, the ammunition assembly 90 includes a structural member 92 that has a hollow intermediate portion 94 having an interior space 98 that communicates with the first and second engagement portions. An elongated ignition device 120 can be at least partially positioned in the interior space 98 of the hollow intermediate portion 94. In other embodiments, the intermediate portion 94 can have other shapes and configuration including, for example, rectangular tubes, and other structures having internal areas that can contain the ignition device or other components.

Figure 6:
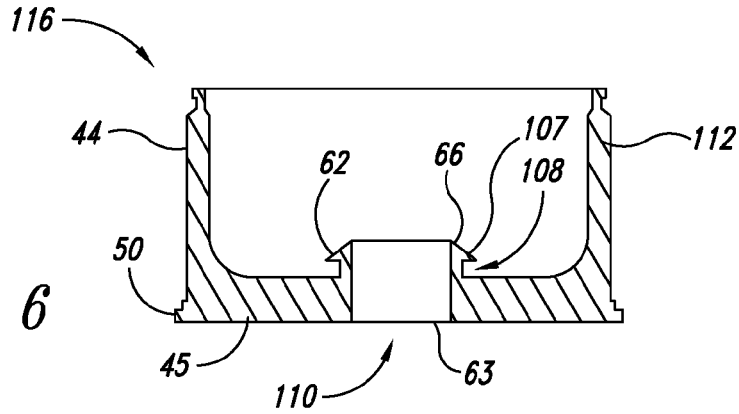
FIG. 6 is a partial cross-sectional view of the case base shown removed from the assembly of FIG. 5 in accordance with one embodiment of the invention.

FIG. 6 is a partial cross-sectional view of the case base 116 shown removed from the ammunition assembly of FIG. 5. In the illustrated embodiment, several components of the case base 116 are similar to the components of the case base 16 of FIGS. 2A and 2B described above. As such, like reference symbols refer to like features and components in FIGS. 2A and 2B. In one aspect of this embodiment, the case base 116 includes a primer boss 110 generally similar in structure and function to the primer boss 48 of FIG. 1, except that the primer boss 110 includes radially extending, tapered shoulder 107. The tapered shoulder 107 is spaced apart from the bottom of the case base to define a notch 108 configured to receive the spring disc 93 and the snap ring 95. The shoulder 107 blocks the spring disc 93 and the snap ring 95 from lifting off of the primer boss 110 after they are installed, thereby locking the distal component 38 of the body 14 to the case base 16.

Figure 7A:
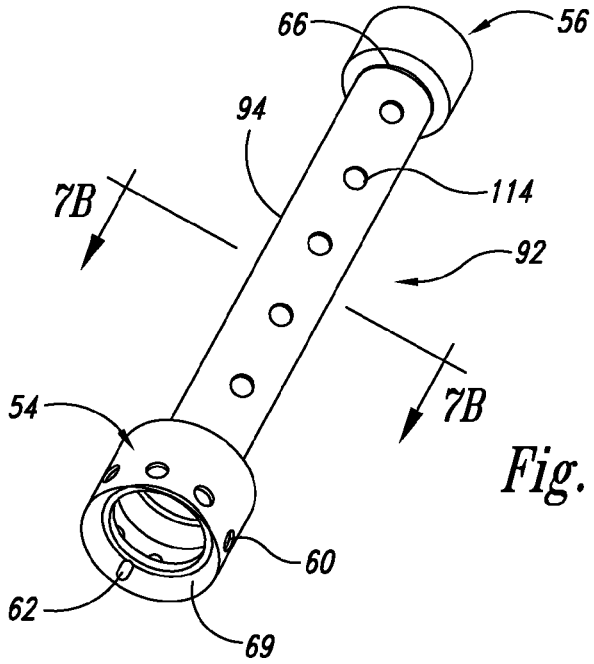
FIGS. 7A and 7B are various views of the structural member shown removed from the assembly of FIG. 5 in accordance with one embodiment of the invention.
Figure 7B:
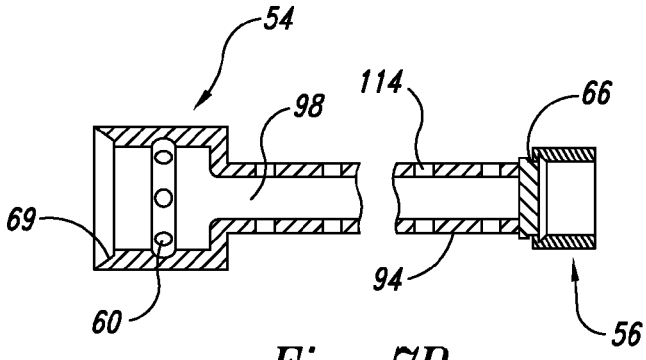

FIG. 7A is an isometric view of the structural member 92 shown removed from the assembly of FIG. 5. FIG. 7B is a cross-sectional view of the structural member 92 taken substantially along line 7B-7B of FIG. 7A. In the illustrated embodiment, several components of the structural member 92 are similar to the components of the structural member 28 of FIG. 3A described above. As such, like reference symbols refer to like features and components in FIG. 3A. In one aspect of this embodiment, the structural member 92 is a tubular structure with a hollow interior area 98 extending through the intermediate portion 94 and the first engagement portion 54. The interior space 98 is shaped and sized to receive and contain an elongated ignition device 120, discussed in greater detail below. The first engagement portion 54 and the intermediate portion include a plurality of apertures 114 extending therethrough and in communication with the interior space 98. The apertures 114 allow hot ignition gases and/or flames generated by the ignition device within the interior area to pass through the structural member 92 and ignite the propellant charge 18 within the body 14 when the assembly is fired.

In another embodiment, the second engagement portion 56 of the structural member 92 is also hollow, so as to communicate with the interior space 98. Accordingly, when the ammunition assembly is fired, burning gases and flame from the ignition device 120 (FIG. 5) can pass through the second engagement portion 54 to ignite a tracer 21 on the projectile and positioned in or adjacent to the second engagement portion thereby allowing for efficient ignition of the tracer 21.

Figure 8:
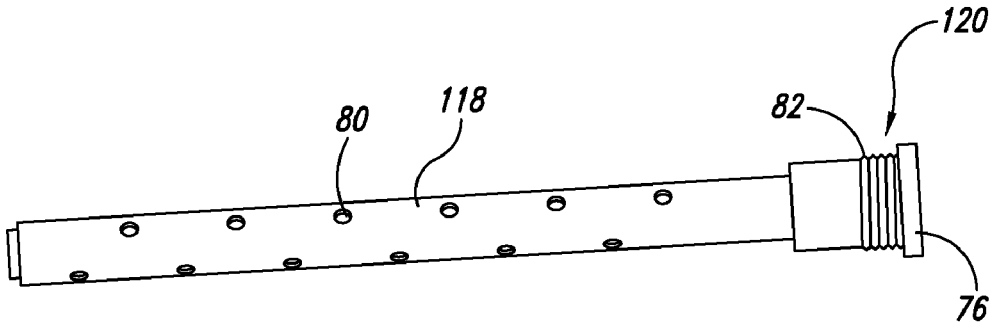
FIG. 8 is an isometric view of the ignition device shown removed from the assembly of FIG. 5 in accordance with one embodiment of the invention.

FIG. 8 is an isometric view of the ignition device 120 shown removed from the assembly of FIG. 5. In the illustrated embodiment, several components of the ignition device 120 are similar to the components of the ignition device 20 of FIG. 4 described above except that the ignition device 120 has an elongated tube portion 118. In one embodiment, the tube portion 118 is shaped and sized to fit within substantially all of the interior area 98 of the structural member 92. In another embodiment, the tube portion 118 can be shorter and fit within only a portion of the interior area 98 of the structural member.

In one embodiment, the tube portion 118 contains an ignition compound therein. The tube portion 118 has a plurality of apertures 80 extending therethrough that communicate with the ignition compound. Upon firing, the burning gases and/or flame produced by the burning ignition compound pass through the apertures 80 of the ignition device 120 and through the apertures 114 of the structural member 92 (FIG. 7A) so as to ignite the propellant charge 18 in the body 14 (FIG. 5). The tube portion 118 of the ignition device 120 can be constructed of a non-combustible material, or a combustible material.

Figure 9:
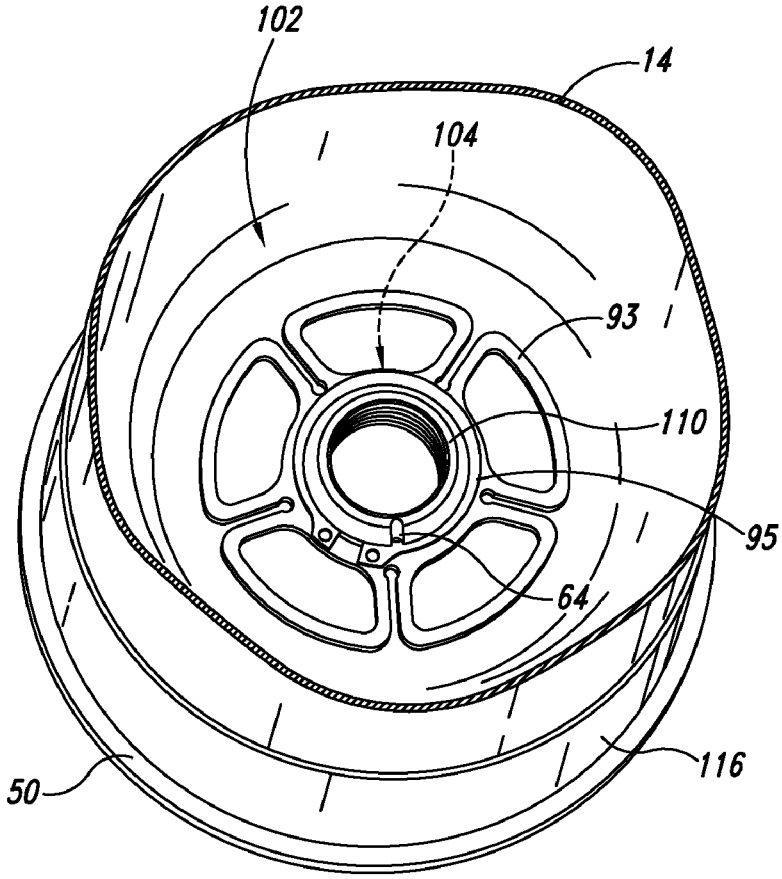
FIG. 9 is a top isometric view of a case base/body assembly of a CCC ammunition assembly of another embodiment at a step in a manufacturing process.
Figure 10:
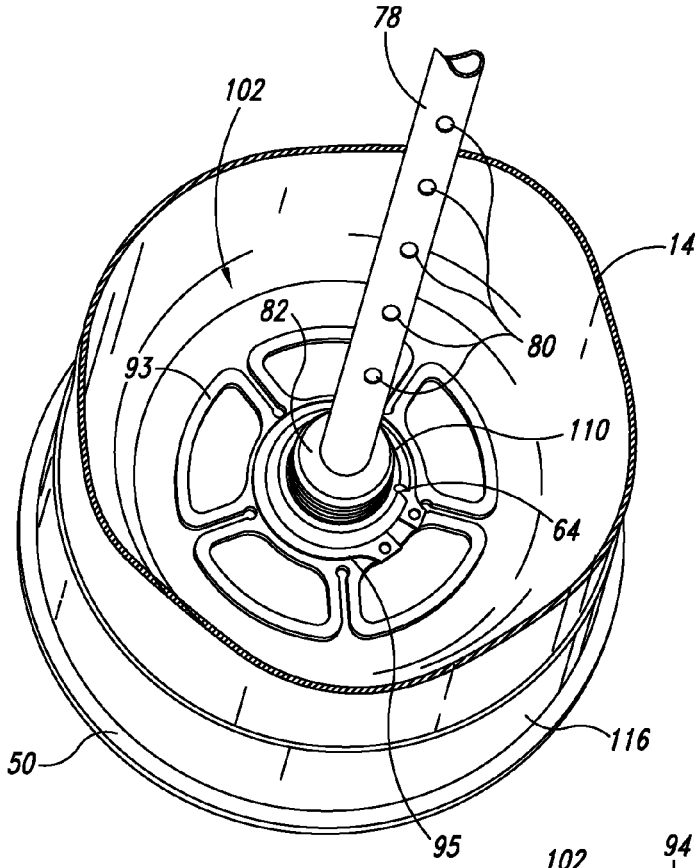
FIG. 10 is a top isometric view of a case base/body/ignition device assembly of a CCC ammunition assembly of another embodiment with an installed ignition device.
Figure 11:
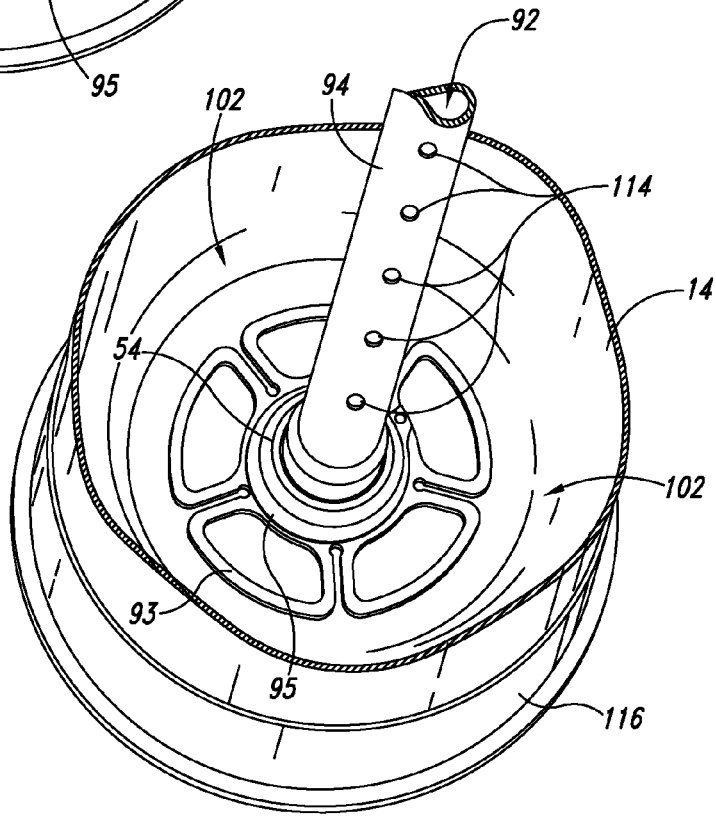
FIG. 11 is a top isometric view of a case base/body/structural member assembly of a CCC ammunition assembly of another embodiment with an installed ignition device and a structural member.

FIGS. 9-11 are top isometric views of a case base/body assembly of FIG. 5 during steps in a manufacturing process, in accordance with another embodiment of the invention. In the illustrated embodiments, a portion of the body 14 has been removed for clarity. During assembly, projectile is connected to the structural member and to the body 14, and the propellant charge is disposed in at least a portion of the body 14. The dome section 102 of the body 14 is inserted into the case base 116 such that the central hole 104 fits over the primer boss 110. The spring disc 93 is pressed over the primer boss and against the dome section 102, and the snap ring 95 is pressed over the primer boss until it snaps into the notch 108, thereby putting the spring disc 93 under compression and locked against the dome section (FIG. 9). The structural member 92 is positioned in alignment and engagement with the primer boss 110. The elongated ignition device 120 is inserted through the primer boss 110 and into the hollow structural member 92. The external threads 82 on the ignition device 120 extend through the primer boss and engage the internal threads in the first engagement portion of the structural member. The ignition device 120 is rotated relative to the case base and screwed into secure engagement with the structural member, thereby locking the structural member and the case base together. The anti-rotation device 62 on the structural member 92 mates with the groove in the primer boss so as to prevent rotational movement of the structural member (and projectile) relative to the case base (FIG. 10).

Figure 12:
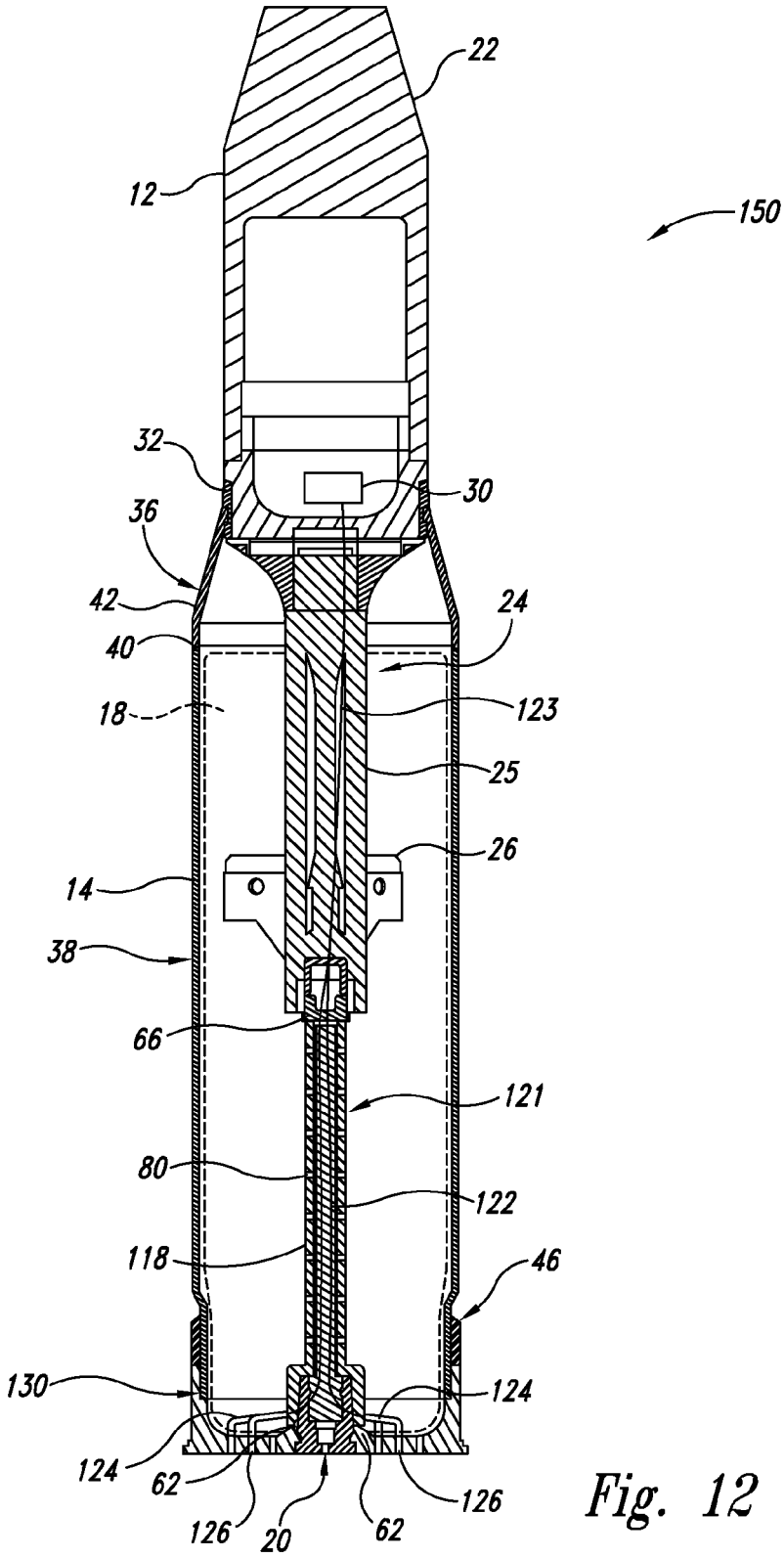
FIG. 12 is a cross-sectional view of a CCC ammunition assembly in accordance with a further embodiment of the present invention.

FIG. 12 is a cross-sectional view of an ammunition assembly 150 in accordance with another embodiment of the present invention. In this embodiment, several components of the ammunition assembly 150 are similar to the components of the ammunition assemblies 10 and 90 described above. As such, like reference symbols refer to like features and components in FIGS. 1-11. In one aspect of this embodiment, the ammunition assembly 150 includes a projectile 12 having a programmable smart fuse 30 that controls when and/or how the projectile will detonate or otherwise behave after the ammunition assembly is fired. The smart fuse 30 of the illustrated embodiment is configured to be programmed or reprogrammed via an external computer in a fire control system. The smart fuse has a plurality of electrical/data contacts through which program data can pass to program or re-program the projectile.

The ammunition assembly 150 includes a hollow structural member 121 generally similar in structure and function to the structure member 92 discussed above of FIG. 7A. The hollow structural member 121 rigidly interconnects the projectile 12 to the case base 130 substantially as discussed above and provides the alternative load path to protect the combustible body 14. The structure member 121 houses an electrical/data communication link 123 coupled at one end to the smart fuse 30, and coupleable at the other end to the external computer of the fire control system. Accordingly, the electrical/data communication link enables smart fuse 30 to be programmed or reprogrammed by the external computer after the ammunition assembly 150 is put together.

In the illustrated embodiment, the communications link 123 has one or more data link cables 122 extending through the hollow intermediate portion. The data link cables are connected to connectors 124 (e.g., electrical receptacles, pins, optic couplers, etc.) in the case base 130. The data link cables can be electrical wires, such as shielded or unshielded twisted pairs, or non-electric wires/cables, such as optic fibers, or other data signal carrying devices. The case base 130 has a plurality of exterior contact portions 126 (e.g., ring-shaped metal layers, pins, couplers, etc.) operatively attached to the connectors 124 and configured to interface with the computer or other external programming device of the control system.

Figure 13:
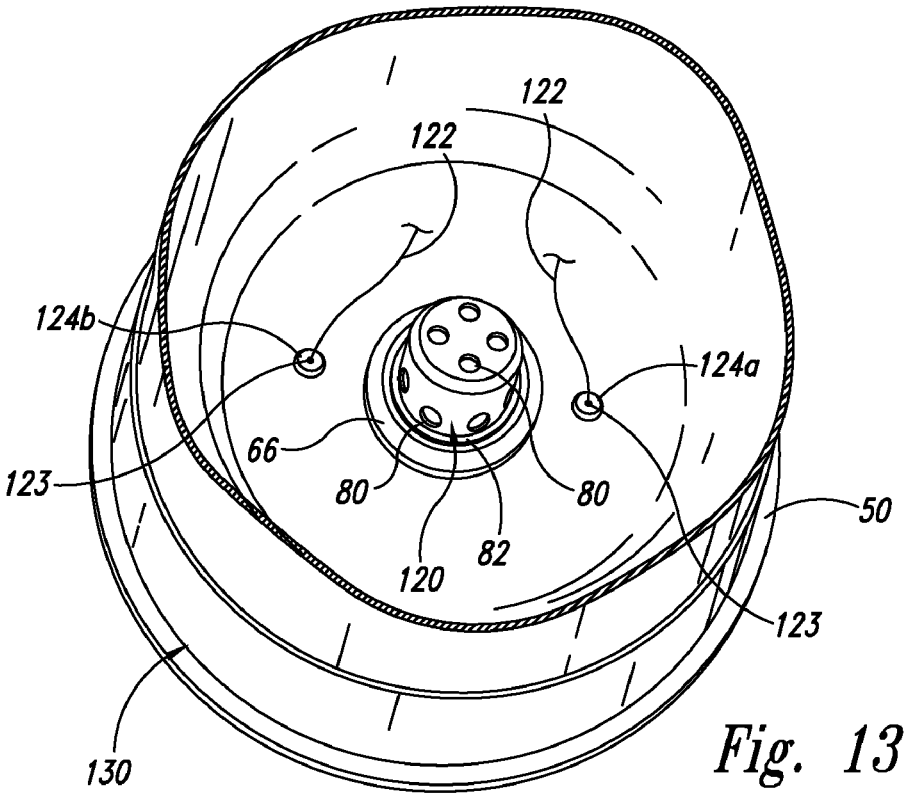
FIG. 13 is a partial isometric top view of the case base shown removed from the assembly of FIG. 12 in accordance with one embodiment of the invention.
Figure 14:
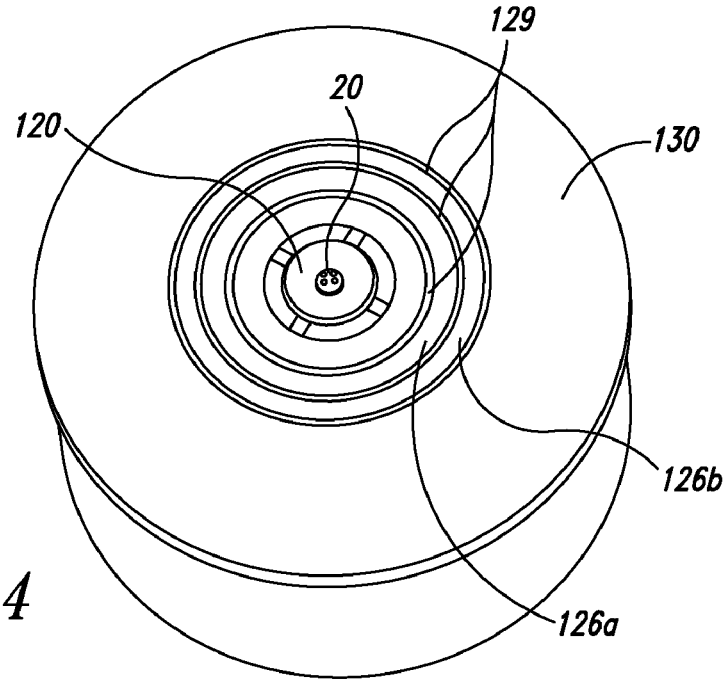
FIG. 14 is an isometric bottom view of the case base shown removed from the assembly of FIG. 12 in accordance with one embodiment of the invention.

FIG. 13 is a partial isometric top view of the case base 130 shown removed from the assembly of FIG. 12, and FIG. 14 is an isometric bottom view of the case base 130 shown removed from the assembly of FIG. 12. In one aspect of this embodiment, the case base 130 includes two connectors 124*a* and 124*b* integrally connected to the closed end of the case base 130. The connectors 124*a* and 124*b* are operatively connected to the data link cables 122 (shown in phantom lines) that extend into the hollow structural member 121 as discussed above. The connectors 124*a* and 124*b* and the data link cables 122 are operatively connected to two exterior contact portions 126*a* and 126*b*. As illustrated in FIG. 14, the case base 130 further includes a plurality of insulators 129 interposed between the external electrical contacts 126*a* and 126*b* to electrically insulate the each contact from the other.

In the illustrated embodiment, the external contacts 126*a* and 126*b* are ring-shaped connectors concentrically arranged around the ignition device 120. Accordingly, the lateral position of the external connectors relative to the central axis of the ammunition assembly remains substantially constant even if the ammunition assembly 150 is rotated about the central axis. For example, when the ammunition assembly 150 is loaded in a firing device (e.g., a gun), the position of the external contacts remain fixed relative to the central axis. If the firing device has contacts coupled to the computer of the control system, the smart fuse 30 can be programmed or reprogrammed after the ammunition assembly 150 has been loaded into the firing device. In one embodiment, the fire control system can receive or generate programming information (e.g., targeting information) based on current battle field conditions. The external computer can provide the programming information through the external electrical contacts 126*a* and 126*b* via, for example, contacts in the breech of the firing device. Then, the programming information is provided to the smart fuse 30 via the communications link 123. Optionally, the smart fuse 30 can send a confirmation signal back to the fire control system via the communications link following the reverse route.

The illustrated communication link 123 does not require unloading the ammunition assembly 150 before re-programming. Another advantage of several embodiments of the communication link 123 is that the structural member 121 protects the data link cables 122 from damage and/or wear, such as from the propellant charge 18. If the data link cables 122 are exposed to an abrasive propellant charge 18, the charge could damage the data link cable 122 due to vibration or other factors. As a result, disposing the data link cable 122 inside the structural member 121 shields and protects the data link cable 122. The hollow structural member 121 can also be a conduit for other features extending between the projectile 12 and the case base 130.

Although the illustrated embodiments show that the communication link includes a cable, in other embodiments, different configurations for establishing electrical communication can be used. For example, in another embodiment, the structural member 121 can electrically connect the connectors 124 to the smart fuse 30. Accordingly, the present invention is not limited to having cable connections as shown in FIG. 12, but extends to other combinations of establishing data communication.

The illustrated communication link 123 does not require unloading the ammunition assembly 120 before re-programming. Another advantage of several embodiments of the communication link 123 is that the structural member 121 protects the data link cables 128 from damage and/or wear, such as from the propellant charge 18. If the data link cables 128 are exposed to an abrasive propellant charge 18, the charge could damage the data link cable 128 due to vibration or other factors. As a result, disposing the data link cable 128 inside the structural member 121 shields and protects the data link cable 128. The hollow structural member 121 can also be a conduit for other features extending between the projectile 12 and the case base 16.

Although the illustrated embodiments show that the communication link includes a cable, in other embodiments, different configurations for establishing electrical communication can be used. For example, in another embodiment, the structural member 121 can electrically connect the connectors 124 to the smart fuse 30. Accordingly, the present invention is not limited to having cable connections as shown in FIG. 15, but extends to other combinations of establishing data communication.

The illustrated embodiments show certain combinations of components. In other embodiments, however, the components can be combined in other ways. For example, the ammunition assembly 10 can incorporate the structural member 92 of FIG. 5 and the ignition device of FIG. 6. In another embodiment, a combustible sleeve (not shown) can be used to engage the body 14 and case base 16 by forming lap-type joints with these components, as described in detail in U.S. Provisional Patent Application No. 60/757,142, filed Jan. 6, 2006, entitled "COMBUSTIBLE CARTRIDGE CASED AMMUNITION ASSEMBLY," which is incorporated herein in its entirety by reference. Accordingly, the present invention is not limited to the particular arrangement shown in FIGS. 1-14, but extends to other combinations of the various components.

From the foregoing, it will be appreciated that specific embodiments of the invention have been described herein for purposes of illustration, but that various modifications may be made without deviating from the spirit and scope of the invention. Accordingly, the invention is not limited except as by the appended claims.

I claim:

1. An ammunition round assembly, comprising:

a projectile having a leading portion and a trailing portion opposite the leading portion;

a body made of a material configured to be consumed upon firing the ammunition round assembly, the body having an interior area, a first end portion coupled to the projectile, and a second end portion opposite the first end and spaced apart from the projectile;

a non-combustible base at least partially enclosing the second end portion of the body; and a structural member positioned inside the interior area and having first and second engagement portions, the structural member forming an axially aligned structural interconnection between the base and the projectile, the first engagement portion securely coupled to the base and spaced apart from the projectile, and the second engagement portion securely coupled to the trailing portion of the projectile and spaced apart from the base, wherein the projectile, the structural member, and the base define a load path that substantially isolates the body from loads applied to the projectile or the base.

2. The ammunition round assembly of claim 1, further comprising an ignition device extending through the base and securely engaging the structural member.

3. The ammunition round assembly of claim 1 wherein the first engagement portion includes a hollow portion adjacent to the base, and the base has a boss configured to engage the hollow portion of the first engagement portion.

4. The ammunition round assembly of claim 3, further comprising an ignition device connectable to the base wherein the first engagement portion and the boss are configured to receive at least a portion of the ignition device.

5. The ammunition round assembly of claim 1 wherein the base has an alignment portion that aligns the structural member relative to the base.

6. The ammunition round assembly of claim 1 wherein at least one of the base and the structural member has an anti-rotation device that substantially blocks rotation of the structural member relative to the base.

7. The ammunition round assembly of claim 1 wherein the structural member further includes a portion adjacent to the base that has a plurality of apertures configured to allow ignition gases to pass therethrough to ignite a propellant in the interior area of the body.

8. The ammunition round assembly of claim 1 wherein the structural member is at least partially hollow and configured to contain an ignition device, the structural member having a plurality of ignition pathways in communication with the interior area of the body.

9. The ammunition round assembly of claim 1, further comprising an ignition device connectable to the base and the structural member, the ignition device configured to hold the structural member in firm engagement with the base.

10. The ammunition round assembly of claim 1 wherein the second engagement portion includes a break-joint feature configured to break when the ammunition round is fired, thereby separating the projectile from the structural member.

11. The ammunition round assembly of claim 1 wherein the projectile includes a programmable portion, and further includes a communication data link extending between the base and the programmable portion and along a portion of the structural member.

12. The ammunition round assembly of claim 1 wherein the projectile includes a programmable portion, and further comprising a communication data link coupled to the programmable portion and extending through a portion of the structural member, the communication data link being connected to a connector configured to allow projectile programming data to pass therethrough.

13. The ammunition round assembly of claim 1 wherein the structural member has a conduit portion, and the projectile has a programmable fuse, and further comprising a communication data link disposed in the conduit portion of the structural member and coupled to the programmable fuse.

14. The ammunition round assembly of claim 1 where in the projectile has a programmable portion and further comprising a communication data link coupled to the programmable portion, the base having a contact portion operably coupled to the communication data link, the contact portion and communication data link being configured so the programmable portion can be programmed by data passing through the contact portion and the communication data link when the ammunition round assembly is in a firing device.

15. The ammunition round assembly of claim 1 wherein the first engagement portion is directly coupled to the base, and wherein the second engagement portion is directly coupled to the trailing portion of the projectile.

16. The ammunition round assembly of claim 15, further comprising an intermediate feature between at least one of the first engagement portion and the base and the second engagement feature and the trailing portion of the projectile.

17. An ammunition round assembly, comprising:

a projectile having a longitudinal axis, a leading portion, and a trailing portion opposite the leading portion;

a body having an interior area and being made of a material configured to be consumed upon firing the ammunition round assembly;

a base connected to the body spaced apart from the projectile;

a structural member structurally interconnecting the trailing portion of the projectile and the base and configured to form a load path there between to substantially isolate the body from loads applied to the projectile on the base, the structural member being substantially axially aligned with the longitudinal axis of the projectile, wherein the structural member includes a hollow portion at the first engagement member;

a propellant charge disposed in the interior area of the body and around the structural member; and an ignition device at least partially in the hollow portion of the structural member.

18. The ammunition round assembly of claim 17 wherein the structural member is substantially rigid.

19. The ammunition round assembly of claim 17 wherein the structural member includes a hollow tube having a plurality of apertures therein.

20. The ammunition round assembly of claim 17 wherein the structural member further includes a break-joint feature configured to disjoint at a specific tension loading.

21. The ammunition round assembly of claim 17 wherein the structural member includes a first cup-shaped structure having an inner wall surface, an outer wall surface, and a countersunk tapered surface extending between the inner and outer wall surfaces.

22. The ammunition round assembly of claim 21 wherein structural member further includes a pin extending from the countersunk tapered surface of the first cup-shaped structure.

23. The ammunition round assembly of claim 17 wherein the ignition device extends through the base and engages the structural member.

24. The ammunition round assembly of claim 17, further comprising a programmable fuse coupled to the projectile, at least one communication port coupled to the base, and communication members extending through the hollow portion of the structural member between the programmable fuse and the communication port.

25. The ammunition round assembly of claim 17 wherein the hollow portion extends along an intermediate portion of the structural member between the projectile and the base.

26. An ammunition round assembly, comprising:

a projectile having a trailing portion and a leading portion;

a body made of a material configured to be consumed upon firing the ammunition round assembly, the body having an interior area, a first end portion coupled to the projectile, and a second end portion opposite the first end;

a non-combustible base at least partially enclosing the second end portion of the body;

a structural member positioned inside the interior area and having first and second engagement portions, the structural member axially aligned with the projectile and forming a structural interconnection between the base and the projectile, the first engagement portion securely coupled to the base and the second engagement portion securely coupled to the projectile, wherein the second engagement portion includes a break-joint feature configured to break when the ammunition round is fired to separate the projectile from the structural member and the base, and wherein the structural member is configured to substantially isolate the body from loads applied to the projectile or the base;

a propellant contained in the body and disposed about the structural member; and an ignition device attached to the base and extending into a least a portion of the structural member, the structural member being configured to allow the ignition device to ignite the propellant upon ignition of the ignition device.

27. The ammunition round assembly of claim 26 wherein the first engagement portion includes a hollow portion adjacent to the base, and the base has a boss configured to engage the hollow portion of the first engagement portion.

28. The ammunition round assembly of claim 27 wherein the first engagement portion and the boss are configured to receive at least a portion of the ignition device.

29. The ammunition round assembly of claim 26 wherein the base has an alignment portion that aligns the structural member relative to the base.

30. The ammunition round assembly of claim 26 wherein at least one of the base and the structural member has an anti-rotation device that substantially blocks rotation of the structural member relative to the base.

31. The ammunition round assembly of claim 26 wherein the break-joint feature is a hollow tubular structure having a reduced wall thickness.

32. The ammunition round assembly of claim 26 wherein the projectile includes a programmable portion, and further includes a communication data link extending between the base and the programmable portion and along a portion of the structural member.

33. The ammunition round assembly of claim 26 wherein the structural member has an axial passageway therethrough, and the projectile includes a programmable portion, and further includes a communication data link extending between the base and the programmable portion through the axial passageway of the structural member.

34. An ammunition round assembly, comprising:

a projectile having a leading portion, a trailing portion opposite the leading portion, and a programmable portion;

a body having an interior area, a first end portion coupled to the projectile, and a second end portion opposite the first end, wherein the body is made of a material configured to be consumed upon firing the ammunition round assembly;

a non-combustible base at least partially enclosing the second end portion of the body;

a structural member within the interior area of the body and coaxially aligned with the projectile, the structural member having a first engagement portion, a second engagement portion opposite the first engagement portion, and a conduit between the first and second engagement portions, the first engagement portion connected to the base and spaced apart from the projectile, the second engagement portion connected to the trailing portion of the projectile and spaced apart from the base, the structural member forming an axially aligned structural interconnection between the base and the projectile such that the projectile, the structural member, and the base define a load path that substantially isolates the body from loads applied to the projectile or the base;

a propellant charge in the interior area of the body; and at least one communication link extending through the conduit of the structural member and connected to the programmable portion of the projectile, wherein the conduit is configured to substantially isolate the communication link from the propellant charge.

* * * * *